US006233987B1

(12) United States Patent
Ueno et al.

(10) Patent No.: US 6,233,987 B1
(45) Date of Patent: May 22, 2001

(54) KEY HOLDER

(75) Inventors: Miho Ueno; Katsuhiko Onoo, both of Tokyo (JP)

(73) Assignee: Tomy Company LTD, Tokyo (JP)

( * ) Notice: Subject to any disclaimer, the term of this patent is extended or adjusted under 35 U.S.C. 154(b) by 0 days.

(21) Appl. No.: 09/558,145

(22) Filed: Apr. 26, 2000

(30) Foreign Application Priority Data

May 7, 1999 (JP) ..... 11-127460

(51) Int. Cl.[7] ..... E05B 19/04
(52) U.S. Cl. ..... 70/408; 70/395; 70/456 R
(58) Field of Search ..... 70/395, 408, 456 R

(56) References Cited

U.S. PATENT DOCUMENTS 2,964,937 * 12/1960 Lautin ..... 70/456 R
3,208,249 * 9/1965 Stackhouse ..... 70/395
3,349,589 * 10/1967 Fricke ..... 70/395
3,715,900 * 2/1973 Sherman ..... 70/456 R
3,729,965 * 5/1973 Gartner ..... 70/395
3,893,315 * 7/1975 Kamp ..... 70/456 R
4,102,166 * 7/1978 Hughes ..... 70/456 R
4,227,389 * 10/1980 Kartinian ..... 70/456 R
4,281,527 * 8/1981 Leopoldi et al. ..... 70/456 R
4,419,874 * 12/1983 Brentini ..... 70/456 R X
4,422,315 * 12/1983 Klose ..... 70/456 R
4,425,772 * 1/1984 Brewer ..... 70/456 R
4,516,418 * 5/1985 Cuttler ..... 70/456 R
4,576,839 * 3/1986 Parren ..... 70/456 R X
4,901,462 * 2/1990 Wrigley ..... 70/456 R
5,365,760 * 11/1994 Song ..... 70/456 R X
5,768,924 * 6/1998 Song ..... 70/408
6,035,679 * 3/2000 Meroni ..... 70/408 X

* cited by examiner

*Primary Examiner*—Suzanne Dino Barrett
(74) *Attorney, Agent, or Firm*—Staas & Halsey LLP

(57) ABSTRACT

The key holder comprises: a main body having a first opening for receiving a bow part of a key; a sandwiching member for elastically sandwiching the received bow part on both surfaces thereof, and for releasing the sandwich of the bow part by extracting the key forcedly; and a contacting part for contacting a head of the bow part therewith.

7 Claims, 4 Drawing Sheets

KEY HOLDER

BACKGROUND OF THE INVENTION

1. Field of the Invention

The present invention relates to a key holder which is attached to a bow part of a key.

2. Description of the Related Art

With relation to a key holder, various proposals for protecting a human body from static electricity caused by touching a door with hands when the door is locked or is unlocked, by making a main body of a key holder out of insulating material, such as plastic, synthetic resin or the like, and for facilitating the use of a key are offered.

In a structure of such a key holder, for attaching a key thereto, for example, a cover which composes a main body of the key holder is fixed to a bow part of a key by using a screw.

However, according to a method in which the cover is fixed to a bow part of a key by using a screw, a shape of the bow part of the key to be attached to the cover is restricted. Because the key is unsteadily attached to the cover, a load is not certainly transmitted to the key when a door is locked or is unlocked. As a result, there is a problem that it is difficult to use the key.

Although a key holder to which keys having various shapes can be attached is proposed, a thickness of a bow part of the key to be attached to the cover or a length thereof is restricted. When the key is attached to the main body of the key holder, it is necessary to disassemble the main body and assemble it. When the thickness of the key is suitable for the cover, the key is stable in a direction perpendicular to a main surface of a bow part thereof. However, there is a problem that the key cannot be prevented from being unstable in a parallel direction thereof.

SUMMARY OF THE INVENTION

In order to solve the above-described problems, an object of the present invention is to provide a key holder to which a key is easily attached and in which a key is stable.

That is, in accordance with one aspect of the present invention, a key holder comprises: a main body having a first opening for receiving a bow part of a key; a sandwiching member for elastically sandwiching the received bow part on both surfaces thereof, and for releasing the sandwich of the bow part by extracting the key forcedly; and a contacting part for contacting a head of the bow part therewith.

A rubber may be used as a sandwiching member. However, the present invention is not limited to this. A sandwiching plate may be used instead of a rubber. The both surfaces of the bow part may be sandwiched by biasing the sandwiching plate with a spring.

According to the present invention, because the head of the bow part is in contact with the contacting part and the bow part is elastically sandwiched by the sandwiching member in this state, the key is easily attached to the main body without disassembling the main body or assembling it. The key holder can cause the key to be stable without depending on various types of key.

The key holder may further comprise a connector having a hook part for hooking the bow part; wherein the hook part are receivable to the first opening with the bow part, and a holding member for elastically holding the connector so as to maintain a state of inserting the hook part into the main body and for releasing the hold of the hook part by extracting the key forcedly is provided between the main body and the connector.

According to the present invention, because the bow part is elastically sandwiched by the sandwiching member and the connector is elastically held by the holding member so as to maintain a state of inserting the hook part into the main body, the key can be previously prevented from coming off.

An engaging part which projects from a second opening of the main body when the hook part is inserted into the main body may be provided in the connector.

According to the present invention, because the accessory, such as a strap or the like, can be attached to the engaging part, the key holder can be decorated more.

The connector may be removal from the main body. The connector may be irremovably attached to the main body.

The first opening may be formed in a cross shape.

BRIEF DESCRIPTION OF THE DRAWINGS

The present invention will become more fully understood from the detailed description given hereinbelow and the accompanying drawings which are given by way of illustration only, and thus are not intended as a definition of the limits of the present invention, and wherein.

PREFERRED EMBODIMENT OF THE INVENTION

Figure 1:
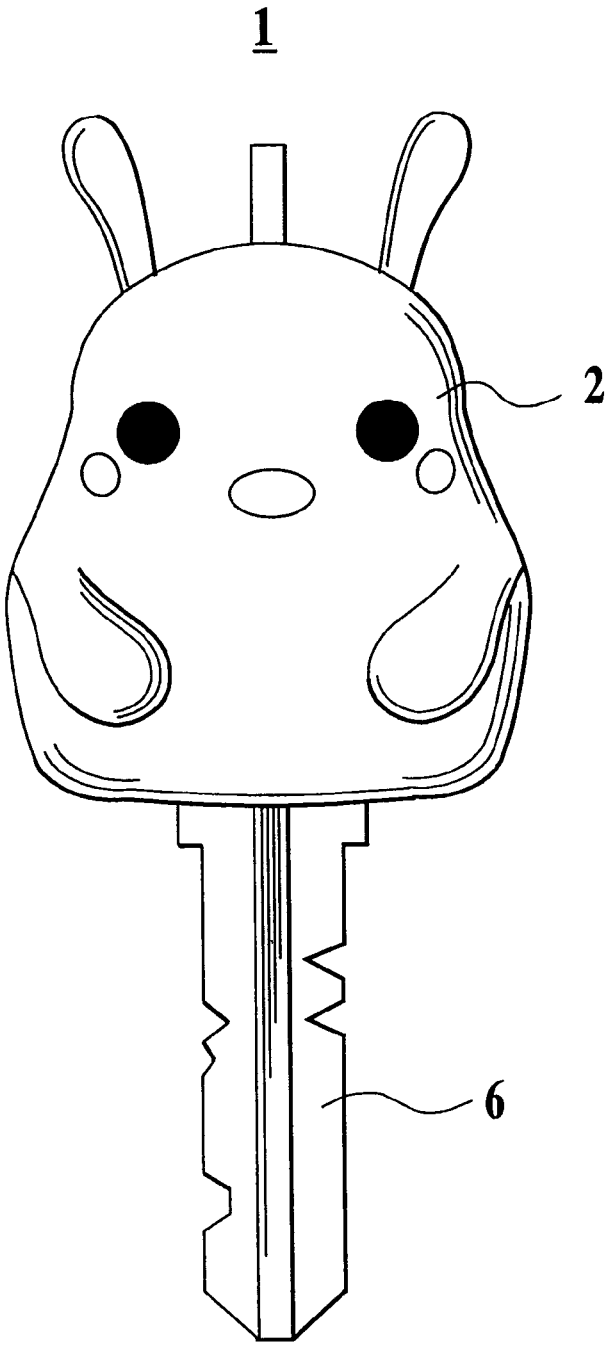
FIG. 1 is a front view showing a key holder according to an embodiment of the present invention.
Figure 2:
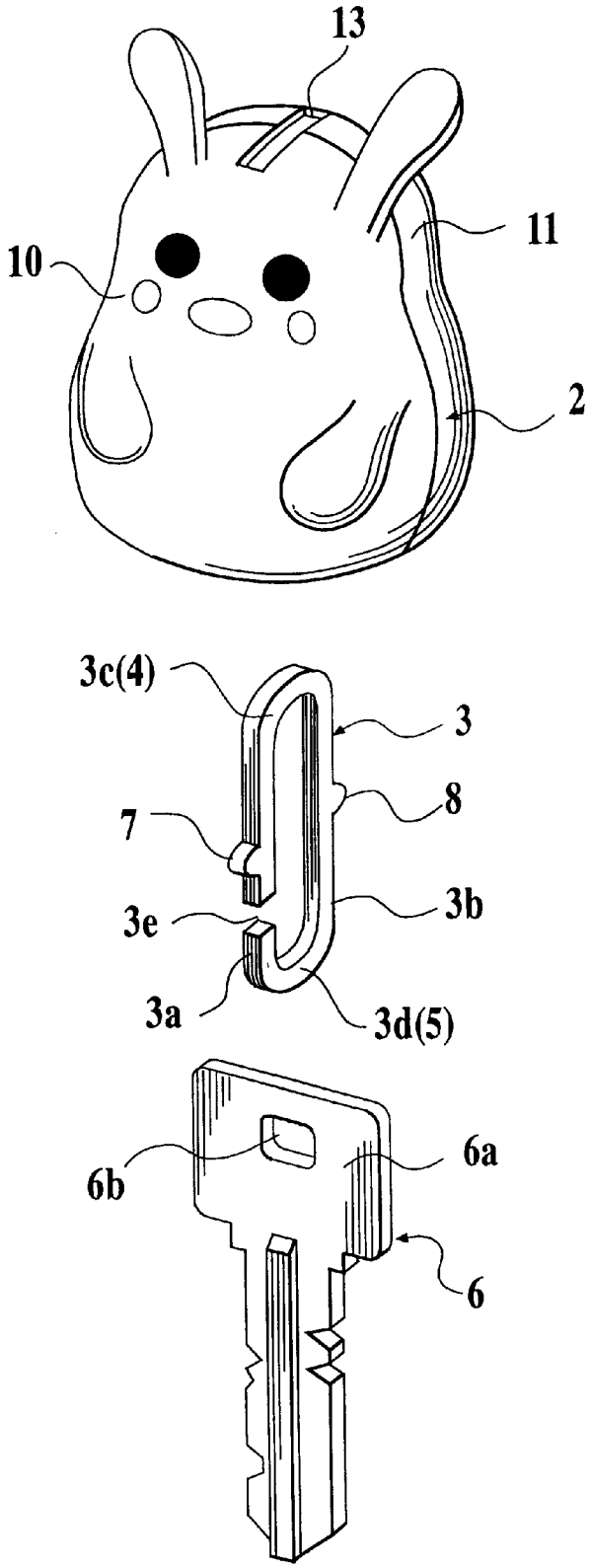
FIG. 2 is an exploded perspective view showing a key holder according to an embodiment of the present invention.

FIGS. 1 and 2 show a key holder according to the present invention.

The key holder 1 comprises a main body 2 which is made of plastic although the present invention is not limited to this, and a connector 3. The connector 3 is formed in a "C"-shape. The both side surf aces thereof are f lat. That is, the connector 3 comprises linear portions 3*a* and 3*b* which are parallel to each other, and curved portions 3*c* and 3*d* having a large curvature. The linear portion 3*a* is cut off at a cut-out portion 3*e*. The both edges in a longitudinal direction of the connector 3, that is, curved portions 3*c* and 3*d* are hooks 4 and 5, respectively. On each hook 4 and 5, a bow part 6*a* of the key 6 can be hooked by using a hole 6*b* thereof through the cut-out portion 3*e*. Each projection 7 and 8 is provided at the middle point of the connector 3 in the longitudinal direction on each outside of the linear portions 3*a* and 3*b* of the connector 3.

The main body 2 has a shape of a doll. The main body 2 is composed of a front frame 10 and a back frame 11 as shown in FIG. 2. The front frame 10 and the back frame 11 are incorporated into one main body by engaging boss holes

Figure 3A:
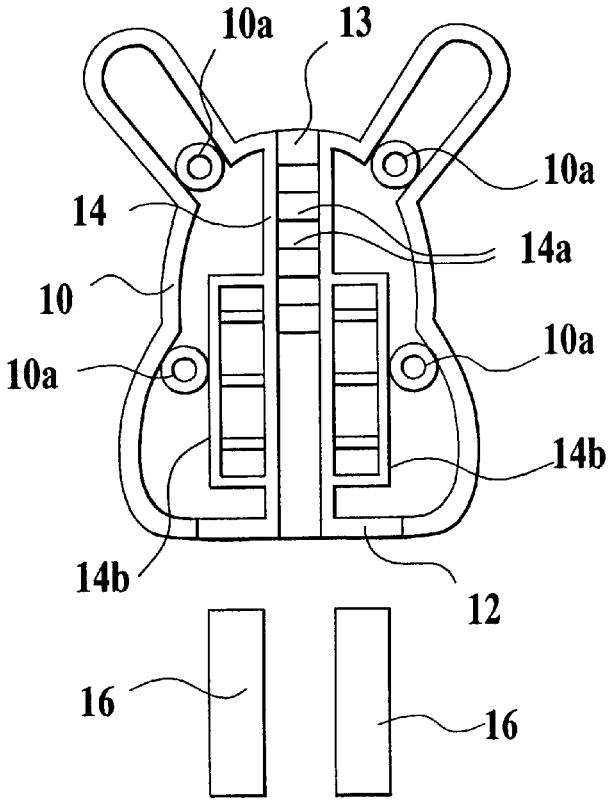
FIG. 3A is a view showing a front frame of the key holder according to an embodiment of the present invention, which is viewed from a rear side thereof.
Figure 3B:
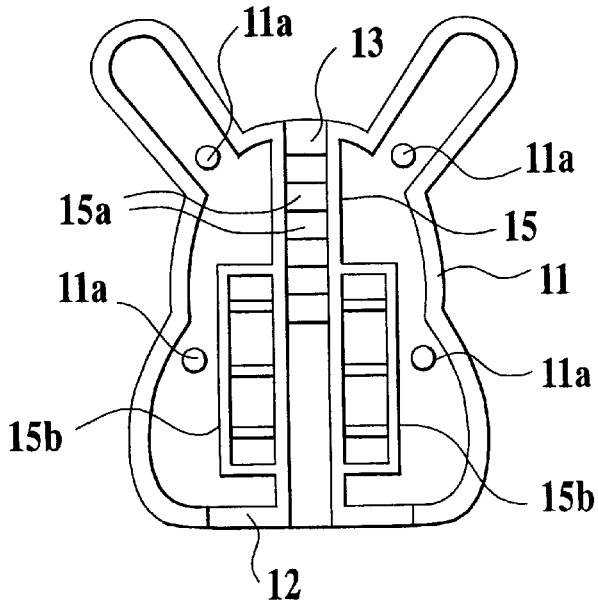
FIG. 3B is a view showing a back frame of the key holder according to an embodiment of the present invention, which is viewed from a rear side thereof.
Figure 4:
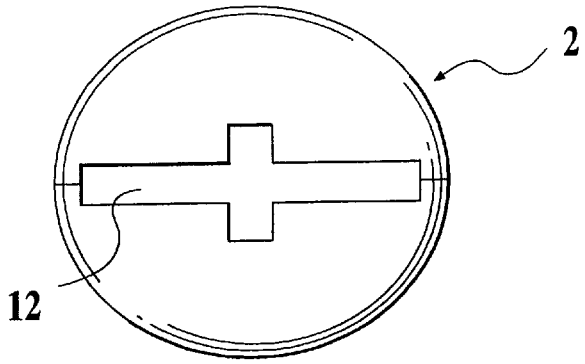
FIG. 4 is a bottom view showing a key holder according to an embodiment of the present invention.

10*a* with bosses 11*a* as shown in FIGS. 3A and 3B. An opening (first opening) 12 is formed by the front frame 10 and the back frame 11 on the lower end of the main body 2 as shown in FIGS. 3A, 3B and 4. An opening (second opening) 13 is formed by the front frame 10 and the back frame 11 on the upper end of the main body 2 as shown in FIGS. 2, 3A and 3B.

Figure 5:
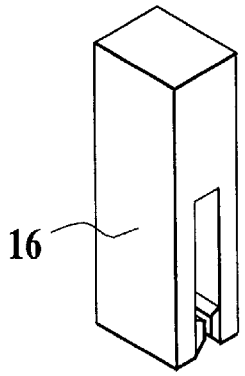
FIG. 5 is a perspective view showing a stopper of the key holder according to an embodiment of the present invention.

The opening 12 has a shape in which the connector 3 and the bow part 6*a* can be inserted into the main body 2 in a state which the bow part 6*a* is hooked on the hook 5 by using the hole 6*b* thereof. Therefore, the opening 12 is formed in a cross shape. Guide members 14 and 15 extending from the opening 12 to the opening 13 are provided in the front frame 10 and the back frame 11, respectively. A path for the connector 3 is formed by the guide members 14 and 15. On the path, a number of concavities (holding member) 14*a* and 15*a* for elastically engaging with the projections (holding member) 7 and 8 of the connector 3 are provided at equal intervals along the path. Seats 14*b* and 15*b* for attaching stoppers (sandwiching member) 16 to the main body 2, which is made of rubber and is formed in a shape in which a rectangular parallelepiped has a notch extending to the center of the rectangular parallelepiped in a longitudinal direction thereof, are provided on both sides of the guide members 14 and 15 so as to be united with the guide members 14 and 15 as shown in FIG. 5. A distance between edges of two sandwiching portions 16*a* of each stopper 16 is shorter than a thickness of the bow part 6*a*. A head of the bow part 6*a* is in contact with a root part of the sandwiching portions 16*a* of each stopper 16, that is, a crotch part thereof (contacting part) when the key 6 is inserted into the main body 2. As a result, the bow part 6*a* can be prevented from being inserted into the main body 2 excessively. Further, the key 6 is effectively prevented from being rotated. That is, because the key 6 is steadily attached to the main body 2 by using the stoppers 16, a load is certainly transmitted to the key 6 when a door is locked or is unlocked.

Figure 6:
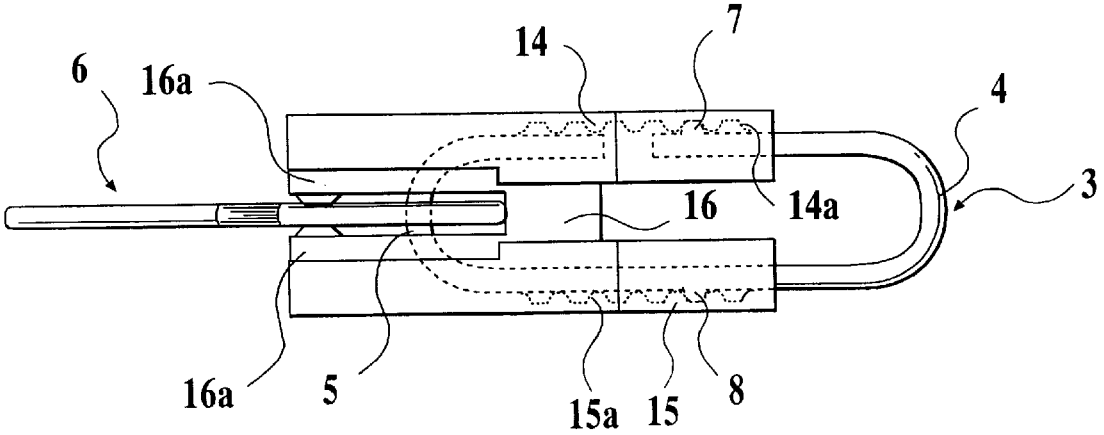
FIG. 6 is a side view showing a relation between a guide member, a stopper and a connector of the key holder according to an embodiment of the present invention, and the key.

An example of the method for using the key holder 1 will be explained below. In a state of extracting the connector 3 or in a state of inserting a part of the connector 3 into the opening 12, a bow part 6*a* of the key 6 can be hooked by using a hole 6*b* thereof through the cut-out portion 3*e*. The connector 3 and the bow part 6*a* are fully pushed into the opening 12. The hook 4 of the connector 3 projects from the opening 13. An accessory, such as a strap or the like, is attached to the hook 4. On the other hand, when the bow part 6*a* is fully pushed into the opening 12, the bow part 6*a* is sandwiched by the stoppers 16 and the head of the bow part 6*a* is in contact with the crotch part of the stopper 16*a*. At the same time, the projections 7 and 8 are engaged with the concavities 14*a* and 15*a* by using an elastic force of the connector 3. As a result, the connector 3 is held so as to maintain a state of inserting the hook 5 into the main body 2 as shown in FIG. 6.

In case of releasing the key 6 from the key holder 1, the key 6 is forcedly extracted from the key holder 1 by a human power. The sandwiched bow part 6*a* is released from the stopper 16. Further, the held connector 3 is released from the concavities 14*a* and 15*a*. As a result, the key 6 is released from the key holder 1 through the cut-out portion 3*e*.

Although the present invention has been explained according to the embodiments, it should also be understood that the present invention is not limited to the embodiments and that various changes and modifications may be made to the invention without departing from the gist thereof.

For example, although the connector 3 is removal from the main body 2 in the key holder 1 according to the above embodiment, the connector 3 may be irremovably attached to the main body 2 and may be movable with respect to the main body 2. In this case, the connector 3 can be prevented from being lost.

Although the key 6 is hooked on the hook 5 in the key holder 1 according to the above embodiment, the key 6 may be hooked on the other hook 4.

According to the present invention, because a key holder comprises: a main body having a first opening for receiving a bow part of a key; a sandwiching member for elastically sandwiching the received bow part on both surfaces thereof, and for releasing the sandwich of the bow part by extracting the key forcedly; and a contacting part for contacting a head of the bow part therewith, the key is easily attached to the main body without disassembling the main body or assembling it. The key holder can cause the key to be stable without depending on various types of key.

The entire disclosure of Japanese Patent Application No. Tokugan-Hei 11-127460 filed on May 7, 1999 including specification, claims drawings and summary are incorporated herein by reference in its entirety.

What is claimed is:

1. A key holder comprising:

a main body having a first opening to receive a bow part of a key;

a sandwiching member to elastically sandwich the received bow part on first and second surfaces thereof, and to release received bow part by extracting the key forcedly;

a contacting part to contact a head of the bow part therewith;

a connector having a hook part to hook the bow part, wherein the hook part is receivable to the first opening with the bow part; and a holding member to elastically hold the connector so as to maintain a state of inserting the hook part into the main body and to release the hold of the hook part by extracting the key forcedly between the main body and the connector.

2. The key holder as claimed in claim 1, wherein an engaging part which projects from a second opening of the main body when the hook part is inserted into the main body is provided in the connector.

3. The key holder as claimed in claim 1, wherein the connector is removal from the main body.

4. The key holder as clamed in claim 2, wherein the connector is removal from the main body.

5. The key holder as claimed in claim 1, wherein the connector is irremovably attached to the main body.

6. The key holder as claimed in claim 2, wherein the connector is irremovably attached to the main body.

7. The key holder as claimed in claim 1, wherein the first opening is formed in a cross shape.

* * * * *